US005413036A

United States Patent [19]

Schiel

[11] Patent Number: 5,413,036

[45] Date of Patent: May 9, 1995

[54] ROLL PRESS, SPECIFICALLY FOR THE PAPER INDUSTRY

[75] Inventor: Christian Schiel, Heidenheim, Germany

[73] Assignee: J. M. Voith GmbH, Heidenheim, Germany

[21] Appl. No.: 163,840

[22] Filed: Dec. 7, 1993

[30] Foreign Application Priority Data

Dec. 12, 1992 [DE] Germany ..... 42 42 022.9

[51] Int. Cl.[6] ..... B30B 3/04

[52] U.S. Cl. ..... 100/168; 100/176; 384/192; 384/419; 384/905

[58] Field of Search ..... 100/155 R, 168, 169, 100/176; 384/192, 418, 419, 905

[56] References Cited

U.S. PATENT DOCUMENTS 1,785,886 12/1930 Barrett ..... 384/419
2,868,594 1/1959 Leister ..... 384/192 X
3,055,242 9/1962 Wilson ..... 100/168 X
3,414,340 12/1968 Heath ..... 384/192
4,837,907 6/1989 Roerig et al. .

FOREIGN PATENT DOCUMENTS 342747 1/1960 Switzerland ..... 100/176

*Primary Examiner*—Stephen F. Gerrity
*Attorney, Agent, or Firm*—Baker & Daniels

[57] ABSTRACT

A roll press with two press rolls which together form a press gap and whose axes are situated in a press plane. A journal is disposed on the ends of each roll, with pillow blocks for receiving the journals, with a rack for supporting the pillow blocks, and with tie rods which are arranged on both sides of the press plane and at least approximately parallel to it. Cradles are provided which support the pillow blocks. Between the cradles and the pillow blocks is an articulated joint which enables the pillow blocks to pivot about an axis which extends perpendicularly to the press plane and essentially in the axial plane of the respective roll.

4 Claims, 3 Drawing Sheets

ROLL PRESS, SPECIFICALLY FOR THE PAPER INDUSTRY

BACKGROUND OF THE INVENTION

The invention concerns a roll press of the type having two press rolls forming with each other a press gap, and having axes situated in a press plane. A journal is disposed on the ends of each roll, with pillow blocks for receiving the journals and a rack for supporting the pillow blocks. Tie rods are arranged on both sides of the press plane, and are generally parallel to it.

Roll presses are known in a plurality of embodiments. Only exemplary reference is made to DE 41 10 205 A1. Here, two press rolls are arranged in a way such that the press plane extends vertically and the press frame, consequently, is of an upright arrangement. There are varying arrangements known as well.

U.S. Pat. No. 4,837,907 describes a roll press with two rolls where the pillow blocks of the one roll are by means of screws fastened to the pillow blocks of the other roll. In the load state, the screws must transfer high tension forces, corresponding to the compression force prevailing in the press gap.

On the categorial roll press, the pillow blocks of the one press roll and those of the other press roll are joined by tie rods which are bendable with relative ease; moreover, the pillow blocks of the one press roll are axially movable in relation to the pillow blocks of the other press roll. This embodiment has several advantages: to begin with, the tie rods are capable of transferring the necessary tension forces. Furthermore, this embodiment allows a quick release and restoration of the coupling between the pillow blocks of the one roll and those of the other. Lastly, this embodiment allows in the case of different length changes of the two rolls a relative movement between both, including their pillow blocks, without creating stresses. This embodiment of a press has proved to be very suitable, for which reason the invention is based on it.

But it has been demonstrated that the said tie rods cannot always be fashioned as bendable as is necessary to avoid stresses. A forced bending of the tie rods can occur, specifically when the axial displacement between the two rolls becomes very large as the result of an extremely different axial expansion. Thus, the tie rods are stressed not only by design tension, but additionally also by an undesirable degree of bending.

The problem underlying the invention is to fashion a roll press in such a way that the tie rods will be stressed extensively by tension.

SUMMARY OF THE INVENTION

This problem is solved by the inventive features of the present invention. In one form thereof, the invention comprises a roll press comprising two press rolls forming with each other a press gap, the respective axes of the press rolls being situated in a press plane. A journal is disposed at an end of each press roll. A respective pillow block receives each journal, and a rack supports the pillow blocks. A tie rod is arranged on each side of the press plane generally parallel to said press plane. A respective cradle is provided for supporting each pillow block, and an articulated joint is arranged between the cradles and the pillow blocks to enable the pillow blocks to pivot about an axis which extends perpendicular to the press plane and generally in the axial plane of the respective press roll.

BRIEF DESCRIPTION OF THE DRAWINGS

The invention will be more fully explained with the aid of the drawing, which in detail shows the following.

DETAILED DESCRIPTION OF THE PREFERRED EMBODIMENT

Figure 1:
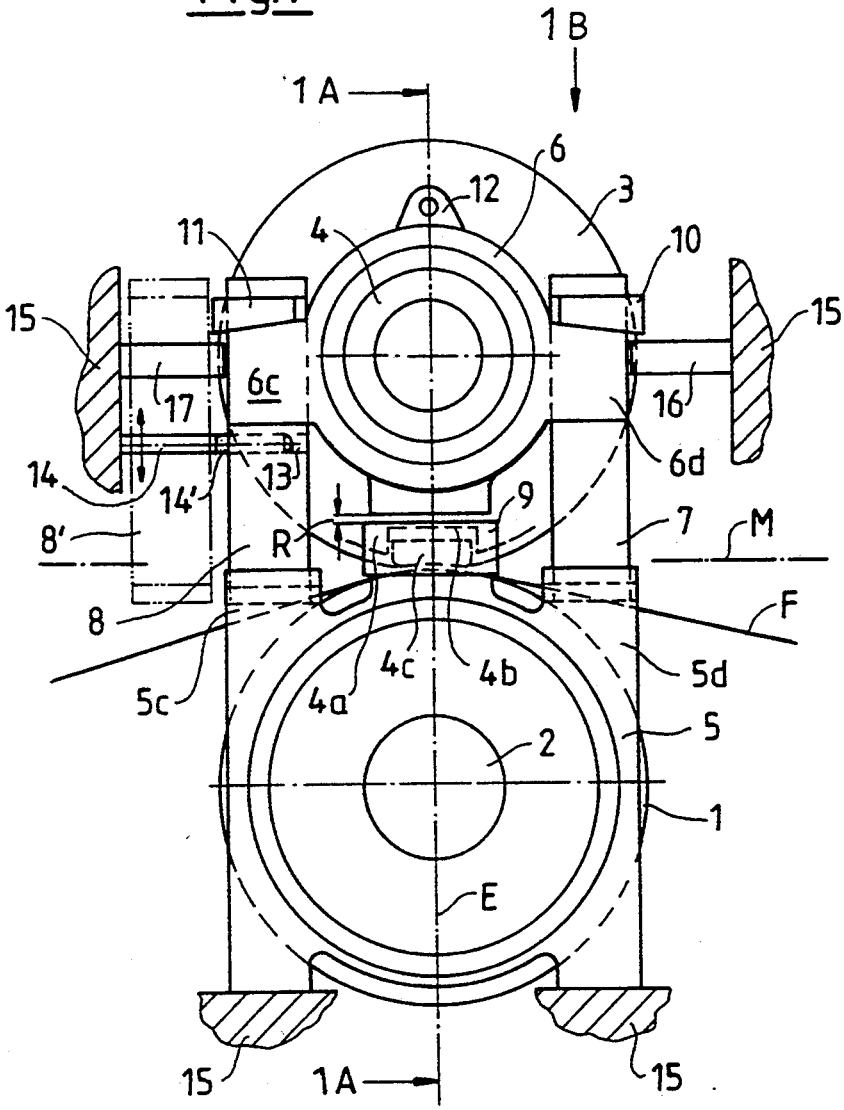
FIG. 1 is a side elevation of a roll press.
Figure 1A:
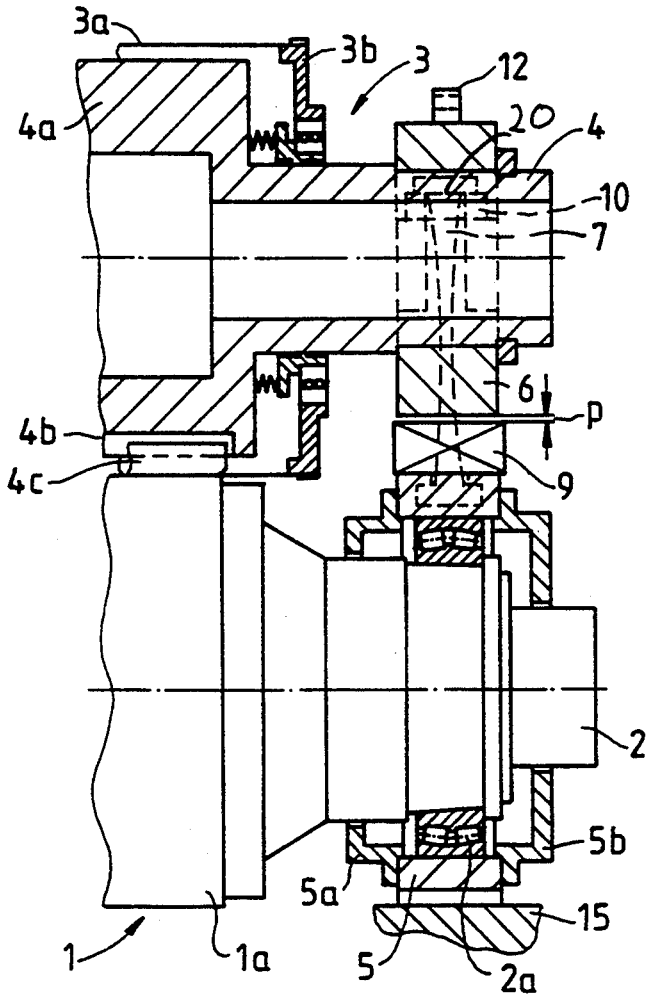
FIG. 1A is a longitudinal section along line 1A—1A in FIG. 1.
Figure 1B:
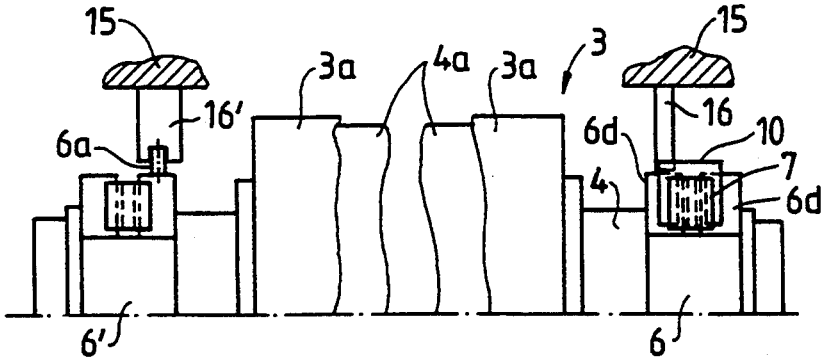
FIG. 1B is a partial view of the roll press relative to FIG. 1, viewed from above in the direction of arrow 1B in FIG. 1.

The roll press illustrated in FIGS. 1, 1A and 1B has a lower, first press roll 1 and an upper, second press roll 3. The axes of these press rolls are situated in a press plane E. The first press roll has a rotatable shell 1*a* and, fastened to it, a journal 2 resting by means of an antifriction bearing 2*a* in a pillow block 5 (with caps 5*a* and 5*b*). The pillow block 5 sits on a frame-shaped machine rack 15, of which several components are indicated in FIG. 1.

The upper, second press roll 3 is a so-called long-gap press roll. Its roll shell 3*a* is a tubular, flexible press shell mounted on two rotatable shell support disks 3*b*. Each of the shell support disks rests on the stationary journal 4 of a stationary support element 4*a* extending through the interior of the roll shell 3*a*. The support element 4*a* has opposite the lower press roll 1 a recess 4*b* and, in it, a piston type, hydraulically actuated press shoe 4*c*. The latter, with its concave sliding surface, forces the press shell 3*a* on the lower press roll 1, thereby forming an extended (in running direction) press gap, through which runs, together with at least one continuous felt F, a paper web to be dewatered.

The upper press roll 3 (on each roll end) rests with the journal 4 in a pillow block, which hereafter will be called "support element 6." Provided between the pillow block 5 and support element 6 is an adapter 9 which is removable and rests on the pillow block 5. Bearing on said adapter is the support element 6 of the upper press roll 3 when the roll press is in its no-load state (i.e., with the recess 4*b* nonpressurized). Illustrated, however, is the load state in which the press shoe 4*c* exerts on the lower press roll 1 a compression force. The reaction forces resulting thereof are transferred, with the aid of pliant tie rods 7 and 8, from the support element 6 to the pillow block 5.

Figure 4:
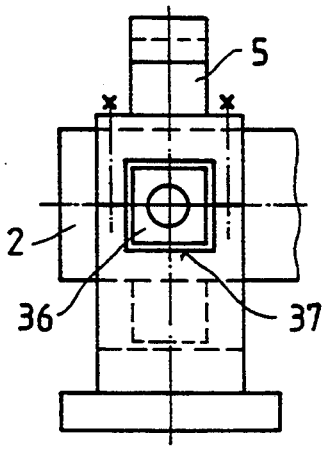
FIGS. 4 and 5 are views analogous to the FIGS. 2 and 3, but of a modified embodiment.

According to FIG. 1, a pliant tie rod 7 each is provided on both sides of the press plane E. These tie rods are inserted from the side into recesses of the pillow block 5 and support element 6. Each of the pliant tie rods 7, 8 has on each end a hammer head 20 and is preferably fashioned after a leaf spring, the "leaf plane" of which extends perpendicularly to the press plane E. This allows the tie rods 7, 8 to deform according to FIG. 4, provided the support element 4, 4a of the second press roll 3 undergoes a length change (for instance thermally induced) and/or flexes under the compression force. Consequently, the support element 6 may be rigidly connected with the journal 4; the previously required axial sliding surface between these two components and a spherical sleeve are dispensable.

The easy axial movability and/or tiltability of the support element 6 (as a length change or flexure of the support element 4, 4*a* occurs) is aided yet by the measure described hereafter: The length of the flexible tie rods 7, 8 is so chosen that the support element 6, in the load state of the roll press, lifts off the adapter 9 somewhat. In other words: a play p is created between the support element 6 and the pillow block 5. The magnitude of this play can be determined by inserting on each of the tie rods 7, 8, between the hammer head 20 and support element 6, a U-shaped wedge 10, 11 more or less deep. With this wedge it is possible, in the no-load state of the roll press, to eliminate the play p or slightly prestress the tie rods 7, 8.

The embodiment according to FIGS. 2 and 3 again shows a roll journal 2, which is installed in a ball bushing, or sleeve, 30 which, in turn, is fitted in the pillow block 5. Here, an especially low-friction slide pairing has been effected, and at that, a ground ball in a housing coating containing PFTE. This creates a smooth tiltability.

The pillow block 5 is pivotably mounted in a cradle 31. The mounting is effected by means of bores 32 in the cradle and pins 33 engaging the bores 32. Provided between the cradles 31 and the pillow blocks 5 is an articulated joint which allows the pillow blocks 5 to pivot about an axis 34 which extends perpendicularly to the press plane E and essentially in the axial plane of the respective roll 1,3. The tilt axis 34 can be seen from FIGS. 3 and 4. The cradle 31 features T-slots 35 for engagement by tie rods 7, 8 not illustrated here, so as to establish a tension connection to the respective cradle of the roll situated above.

Figure 2:
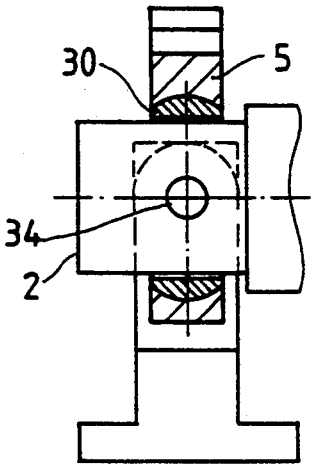
FIGS. 2 and 3 are partial views of an embodiment of an inventional roll press in the end region of this roll; with FIG. 2 being a side elevation and FIG. 3 an end view.
Figure 3:
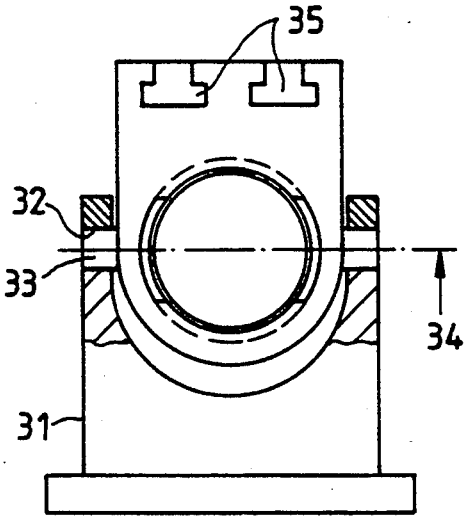
Figure 5:
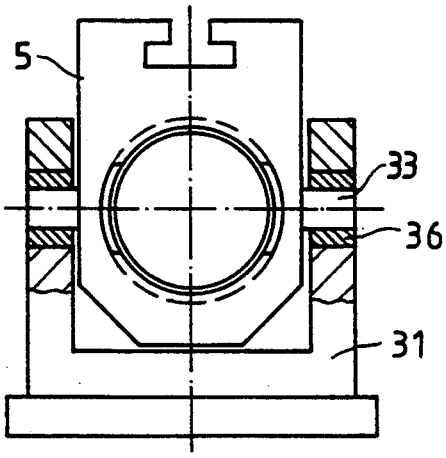

The embodiment according to FIGS. 4 and 5 is very similar to that relative to FIGS. 2 and 3. Provided here, however, on the one end of the roll, is a sliding block 36 which is able to slide in axial direction in a gate type guide 37. The coordination of the sliding block 36 with the pillow block 5 is brought about by installing it on the respective bearing pin 33. The gate type guide 37, on the other hand, is coordinated with the cradle 31.

The arrangement with the sliding blocks and gate type guide serves to absorb length changes between the press frame and roll axis. Such length changes are contingent, e.g., on temperature. The length compensation, naturally, may be provided on only a single roll end, where the movable bearing is contained.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll press comprising:

two press rolls forming with each other a press gap, each press roll having an axis, the respective axes of the press rolls being situated in a press plane;

a journal situated at each end of each of said press rolls;

a respective pillow block for receiving each journal;

a rack for supporting the pillow blocks;

a tie rod arranged on each side of the press plane and arranged generally parallel to said press plane, each tie rod extending between respective pillow blocks;

a respective cradle for supporting each pillow block, each cradle and the pertaining pillow block being movable relative to each other in the direction of the roll axis; and an articulated joint arranged between each of the cradles and the pillow blocks to enable the pillow blocks to pivot about an axis which extends perpendicular to the press plane and generally in the axial plane of the respective press roll.

2. The roll press of claim 1, wherein the journals are mounted in the pillow blocks through the intermediary of ball sleeves.

3. The roll press of claim 1, wherein pivotal mounting between said cradle and pillow block is fashioned by bearing bores and pins engaging the bearing bores.

4. The roll press of claim 1, wherein the movability between said cradle and said pillow block is created by sliding blocks coordinated with one of said cradle and said pillow block and by a gate type guide coordinated with the other of said cradle and said pillow block.

* * * * *